United States Patent [19]

Takimoto et al.

[11] Patent Number: 4,495,276

[45] Date of Patent: Jan. 22, 1985

[54] PHOTOSENSITIVE MATERIALS HAVING IMPROVED ANTISTATIC PROPERTY

[75] Inventors: Masaaki Takimoto; Takashi Saida; Masataka Murata, all of Saitama, Japan

[73] Assignee: Fuji Photo Film Co., Ltd., Kanagawa, Japan

[21] Appl. No.: 253,499

[22] Filed: Apr. 13, 1981

[30] Foreign Application Priority Data

Apr. 11, 1980 [JP] Japan ..... 55-47663

[51] Int. Cl.[3] ..... G03C 1/78

[52] U.S. Cl. ..... 430/527; 430/530

[58] Field of Search ..... 430/527, 530

[56] References Cited

U.S. PATENT DOCUMENTS 3,245,833 4/1964 Trevoy ..... 430/530
3,503,743 3/1970 Kosar ..... 430/530
3,857,729 12/1974 Burwasser ..... 430/527
3,874,879 4/1975 Rasch ..... 430/530
4,078,935 3/1978 Nakagiri et al. ..... 430/527

*Primary Examiner*—Jack P. Brammer
*Attorney, Agent, or Firm*—Sughrue, Mion, Zinn, Macpeak and Seas

[57] ABSTRACT

A silver halide photosensitive material having an improved antistatic property is disclosed, comprising a base support having thereon an electrically conductive layer comprised of fine particles of a crystalline metal oxide selected from the group consisting of ZnO, $TiO_2$, $ZrO_2$, $SnO_2$, $Al_2O_3$, $In_2O_3$, $SiO_2$, MgO, BaO and $MoO_3$ or a composite oxide thereof dispersed in a binder, the light scattering efficiency of said photosensitive material being 50% or less. The electrically conductive layer gives excellent antistatic properties even under low humidity preventing the generation of static charges without damaging photographic properties of the silver halide photosensitive material.

14 Claims, No Drawings

PHOTOSENSITIVE MATERIALS HAVING IMPROVED ANTISTATIC PROPERTY

FIELD OF THE INVENTION

The present invention relates to silver halide photosensitive materials having an improved antistatic property and, particularly, to photosensitive materials in which the antistatic property is improved without having a bad influence on photographic properties.

BACKGROUND OF THE INVENTION

Photosensitive materials generally consist of an electrically insulating base and a photographic layer. Accordingly, static charges often accumulate during production of photosensitive materials or during use. The charges are created by friction between surfaces of similar or different kinds of materials or separation thereof. The accumulated static charges create various bad effects. The most serious effect is that static charges which accumulate before the development processing are discharged exposing the sensitive emulsion layer. This allows for the production of dot spots or branched or fur-like specks on the photographic films when subjected to development processing. They are the so-called "static mark", which may markedly damage or completely destroy the commercial value of the photographic films. Extremely serious effects may occur if static marks appear on medical or industrial X-ray films. This phenomenon is particularly troublesome, because it does not become evident until development is carried out. Further, the accumulated static charges can cause secondary troubles such as dust adheres to the surface of the film or preventing the formation of a uniform coating.

As mentioned above, static charges are often accumulated during production or use of photosensitive materials. For example, during production static charges may be generated by friction between the photographic film and rollers or by detachment of the base face from the emulsion face during winding or rewinding of the photographic film. With respect to finished products, static charges may be generated by detachment of the base face from the emulsion face when the photographic film is rewound or by contact of the X-ray film with machine parts in an automatic camera or with fluorescent sensitizing paper or by separation from them. In addition, they may be generated by contact with wrapping materials. The possibility of having a static mark on photosensitive materials due to the accumulation of static charges increases greatly with an increase in the sensitivity of the photosensitive materials and an increase of the processing rate thereof. Recently, photosensitive materials are even more likely to be highly sensitized and be subjected to severe treatment such as high-speed coating, high-speed photographing or high-speed automatic processing, etc. Consequently, the static marks are more likely to be generated.

The preferred process for removing static electricity is to improve the electric conductivity of the materials so that the static charges disappear for a short period of time before the accumulated charges are discharged. Accordingly, proposed methods involve improving the electric conductivity of the base or various coating surface layer of the photosensitive materials using various hygroscopic substances, water-soluble inorganic salts, certan kinds of surface active agents and polymers. For example, it has been known to use polymers described in U.S. Pat. Nos. 2,882,157, 2,972,535, 3,062,785, 3,262,807, 3,514,291, 3,615,531, 3,753,716 and 3,938,999; surface active agents described in U.S. Pat. Nos. 2,982,651, 3,428,456, 3,457,076, 3,454,625, 3,552,972 and 3,655,387; and colloidal silica described in U.S. Pat. No. 3,525,621.

However, many of these materials show singularity depending on the kind of film base and differences in photographic composition. They may produce good results on certain kinds of film base and photographic emulsion or on other photographic composition elements. However, while they are not only entirely useless on other film bases or other photographic composition elements, they have a bad effects upon photographic properties. Furthermore, many of these materials cannot operate effectively as an electrically conductive layer under low humidity.

A meothd of using stannic oxide as an antistatic agent is described in Japanese Patent Publication No. 6616/60. In this method, a colloid of amorphous stannic oxide is used. However, the electric conductivity of amorphous stannic oxide is humidity dependent and cannot operate effectively under low humidity. Accordingly, it is not essentially different from the various above-described materials.

U.S. Pat. No. 3,062,700 and Japanese Patent Application (OPI) Nos. 113224/77 (the term "OPI" as used herein refers to a "published unexamined Japanese patent application") and 12927/80 disclose crystalline metal oxides such as zinc oxide, stannic oxide or indium oxide which possess electric conductivity not dependent on humidity. These metal oxides are used as an electrically conductive material for a conductive base of electrophotographic sensitive materials or electrostatic recording materials. However, these crystalline metal oxides have not been disclosed as being useful as antistatic agents for silver halide emulsions. Furthermore, it is not possible to determine what sort of interaction might occur between these oxides and a silver halide photosensitive emulsion layer. In support of this statement, it should be pointed out that silver halide and copper halide are disclosed as being used as the electrically conductive materials in U.S. Pat. No. 3,245,833. However, these electrically conductive materials interact with the silver halide emulsion layer as described in U.S. Pat. No. 3,428,451 resulting in bad effects upon photographic properties.

Images are obtained with the use of photosensitive material via transmitted light or reflected light. In the latter case, the reflectivity of the non-image part is preferably as high as possible. On the other hand, in the former case, it is preferable to increase light transmittance of the non-image part, and reduce light scattering caused by the photosensitive material. When attempting to prevent the generation of static charges by introducing an electrically conductive layer into the photosensitive material, there are significant restrictions with respect to reducing the light scattering. Consequently, under existing circumstances, the above-described electrically conductive polymers or surface active agents (which are humidity dependent with respect to electric conductivity) can only be utilized by dissolving them in a binder or by forming a fine micelle state. Accordingly, even though the above-described zinc oxide, electrically conductive stannic oxide and indium oxide described in U.S. Pat. No. 3,062,700 and Japanese Patent Application (OPI) Nos. 113224/77 and 12927/80 can be utilized for electrically conductive paper for electrophotography or electrostatic recording, they cannot be used directly for silver halide photosensitive materials in which the images formed are observed by transmitted light.

SUMMARY OF THE INVENTION

The first object of the present invention is to provide antistatic photosensitive materials.

The second object of the present invention is to provide photosensitive materials having an excellent antistatic property under low humidity.

The third object of the present invention is to provide a process for effectively preventing generation of static charges on the photosensitive materials without damaging photographic properties.

The fourth object of the present invention is to provide photosensitive materials suitable for observing images thereon by transmitted light, which satisfy the above-described objects.

These objects and others have been attained by providing silver halide photosensitive materials having an improved antistatic property which comprises a support having thereon an electrically conductive layer in which fine particles of a crystalline metal oxide selected from the group consisting of ZnO, $TiO_2$, $SnO_2$, $Al_2O_3$, $In_2O_3$, $ZrO_2$ $SiO_2$, MgO, BaO and $MoO_3$ or a composite oxide thereof are dispersed in a binder, wherein the light scattering efficiency of said sensitive material is 50% or less.

DETAILED DESCRIPTION OF THE INVENTION

Preferred electrically conductive fine particles used in the present invention are crystalline metal oxide particles. However, metal oxides having oxygen defects and metal oxides containing a small amount of hetero atoms for forming a donor are also preferred, because they are, generally speaking, highly conductive, and the latter is particularly preferred because it does not fog silver halide emulsions. Preferred examples of the metal oxides include ZnO, $TiO_2$, $SnO_2$, $Al_2O_3$, $In_2O_3$, $SiO_2$, $ZrO_2$, MgO, BaO and $MoO_3$, etc., and composite oxides of them. ZnO, $TiO_2$ and $SnO_2$ are particularly preferred. Examples of hetero atoms contained in the metal oxides include Al and In, for ZnO; Nb and Ta, for $TiO_2$; and Sb, Nb and halogen atoms, for $SnO_2$. A preferable amount of the hetero atoms added is in a range of 0.01 to 30 mol%, particularly 0.1 to 10 mol%.

It is preferred that the particle size of the crystalline metal oxide particles or the composite oxides thereof utilized in the present invention be small in order to reduce light scattering as much as possible. The size should be determined by the ratio of refractive index of the particles to the binder as a parameter. For example, particle sizes corresponding to scattering efficiencies of 5%, 10%, 30% and 50% concerning light having a wavelength of 550 nm, which are calculated by a Mie's theory (see G. Mie, *Ann. Physik*, 25 377 (1908) and T. H. James, *The Theory of the Photographic Process*, 580–584, 4th Ed. (1977), published by Macmillan Co.), are shown in Table 1. Though data analogous to those shown in Table 1 concerning each wavelength are obtained, they are abridged in this specification, and the results shown in Table 1 are regarded as particle size corresponding to a white light scattering efficiency.

TABLE 1

| Scattering Efficiency (%) | Ratio of Refractive Index (Particle/Binder) 1.1 (μ) | 1.2 (μ) | 1.3 (μ) | 1.4 (μ) | 1.5 (μ) | 1.6 (μ) | 2.0 (μ) |
|---|---|---|---|---|---|---|---|
| 5 | 0.33 | 0.20 | 0.16 | 0.13 | 0.12 | 0.11 | 0.09 |
| 10 | 0.44 | 0.25 | 0.19 | 0.16 | 0.14 | 0.13 | 0.11 |
| 30 | 0.70 | 0.38 | 0.27 | 0.23 | 0.19 | 0.18 | 0.14 |
| 50 | 0.90 | 0.47 | 0.33 | 0.27 | 0.23 | 0.20 | 0.16 |

With photosensitive materials, it is preferred that the scattering efficiency in a highlight part of the image is 50% or less in case of sensitive materials wherein the image is observed directly by the naked eye, such as X-ray films. It is preferred that the scattering efficiency in the highlight part is 20% or less in case of sensitive materials wherein the image is utilized by projection, such as color slides, color negative films, black-white negative films or cinema films.

Color prints and black-white printing paper do not require a low degree of light scattering, and the present invention can be of course adopted for them without any disadvantages.

The refractive index of the metal oxides as a body of the electrically conductive particles used in the present invention is shown in Table 2.

TABLE 2

| Metal Oxide | Refractive Index |
|---|---|
| ZnO | 2.0 |
| $TiO_2$ | 2.7–2.9 |
| $SnO_2$ | 2.0 |
| $Al_2O_3$ | 1.7–1.8 |
| $SiO_2$ | 1.5 |
| $ZrO_2$ | 2.1–2.2 |

The binder used in the present invention has a refractive index in a range of about 1.4 to 1.6. Accordingly, based on the values shown in Table 1, a greater portion of the present invention is realized when electrically conductive particles having a particle size of about 0.5μ or less are used. Sensitive materials having a remarkably high light transmittance which have 10% or less of the light scattering efficiency can be obtained when electrically conductive particles having a particle size of 0.2μ or less are used.

Preferably the electrically conductive layer used in the present invention has a surface resistivity of $10^{11}\Omega$ or less, more preferably $10^9\Omega$ or less, at 25° C. under a low humidity of 25% RH. Accordingly, the volume resistivity of the electrically conductive particles is $10^7\Omega$-cm or less, preferably $10^5\Omega$-cm or less if the thickness of the antistatic layer generally used is 1 μm or so.

The electrically conductive fine particles composed of crystalline metal oxides used in the present invention are produced in general by the following processes using, as a starting material, metal powders, hydrates of metal oxides, organic compounds containing a metal such as carboxylates (e.g., acetates, oxalates) and alkoxides, and the like. Firstly, they may be produced by sintering the starting material and heat treatment in the presence of hetero atoms in order to improve the electric conductivity. Secondly, they may be produced by sintering the starting material in the presence of hetero atoms for improving the electric conductivity. Thirdly, they may be produced by sintering the starting material in an atmosphere with a reduced oxygen concentration in order to present oxygen defects.

In the first process, the electric conductivity of the surface of fine particles can be effectively improved. However, it is necessary to select a condition for the heat treatment, because the particles may increase in size. Sometimes, it is preferable to carry out the heat treatment in a reductive atmosphere. The second process is preferable because it is believed to have the lowest cost for production. For example, in a process for obtaining $SiO_2$ fine particles by spraying a $\beta$-stannic acid colloid (amorphous) as a hydrate of $SnO_2$ in a sintering furnace, electrically conductive $SnO_2$ fine particles can be obtained, if antimony chloride, antimony nitrate or a hydrate of antimony oxide is present in the $\beta$-stannic acid colloid. As another example, in the so-called gas phase process for producing $SnO_2$ and $TiO_2$ by oxidation of $SnCl_4$ and $TiCl_4$, electrically conductive $SnO_2$ and $TiO_2$ can be obtained, if a salt of a hetero atom is present at the time of oxidation. Another process comprises decomposing an organic salt of metal by heating it in the presence of a salt of a hetero metal atom. As an example of the third process, there is a vacuum evaporation process for obtaining metal oxide fine particles. The process comprises evaporating metals in an oxygen atmosphere wherein an amount of oxygen is insufficient or metals or metal salts are heated without supplying sufficiently oxygen.

The electrically conductive particles used in the present invention preferably have a smaller particle size within the limits of possibility. However, fine particles obtained by the above-described processes may firmly agglomerate forming large particles. In order to avoid formation of such large particles, auxiliary fine particles which do not contribute directly to improvement of the electric conductivity are used as an assistant for finely granulating in the production of electrically conductive particles. Particles useful for this purpose include fine particles of metal oxide which are not prepared for the purpose of improving the electric conductivity (for example, ZnO, $TiO_2$, $SiO_2$, $Al_2O_3$, MgO, $ZrO_2$, BaO, $WO_3$, $MoO_3$ and $P_2O_5$); fine particles of sulfates such as $BaSO_4$, $SrSO_4$, $CaSO_4$ or $MgSO_4$; and fine particles of carbonates such as $MgCO_3$ or $CaCO_3$.

The particles exemplified in the above can be dispersed in a binder together with electrically conductive fine particles, because they do not have a thick color. Further, in order to remove a greater part of the auxiliary particles and large particles, it is possible to carry out physical or chemical treatments. For example, it is effective to use a process which comprises selectively collecting ultra-fine electrically conductive particles by filtration, decantation, centrifugal precipitation, etc., after the particles have been dispersed and crushed in a liquid by means of a ball mill or a sand mill; and a process which comprises dissolving only the auxiliary particles after crushing as described above. The ultra-fine electrically conductive particles can be more effectively produced if a surface active agent is added as a dispersing agent in the liquid; or by adding a small amount of a binder capable of being used in the present invention or a small amount of Lewis acid or Lewis base in the liquid. Of course, ultra-fine electrically conductive particles can be further effectively obtained by repeating or combining the above-described operations.

It will be apparent to one skilled in the art that the use of a chemical treatment in combination with the foregoing treatment will make possible the use of a much greater range of particles as auxiliary particles.

The binder for the electrically conductive layer may include proteins such as gelatin, colloidal albumin or casein; cellulose compounds such as carboxy methyl cellulose, hydroxyethyl cellulose, diacetyl cellulose or triacetyl cellulose; saccharide derivatives such as agar, sodium alginate or starch derivatives; synthetic hydrophilic colloids, for example, polyvinyl alcohol, poly-N-vinylpyrrolidone, acrylic acid copolymers, polyacrylamide and derivatives and partially hydrolzyed products of them, vinyl polymers and copolymers such as polyvinyl acetate or polyacrylic acid ester; natural materials such as rosin or shellac, and derivatives thereof; and other many synthetic resins. Further, it is possible to use aqueous emulsions of styrene-butadiene copolymer, polyacrylic acid, polyacrylic acid ester or derivatives thereof, polyvinyl acetate, vinyl acetateacrylic acid ester copolymer, polyolefin or olefin-vinyl acetate copolymer.

Alternatively, it is possible to use colloids of a hydrate of metal oxides such as aluminum oxide, tin oxide or vanadium oxide, as a binder.

The binder of the electrically conductive layer may be comprised of known electrically conductive high molecular substances. Examples of these substances include polyvinylbenzenesulfonic acid salts, polyvinylbenzyltrimethyl ammonium chloride, quaternary polymer salts described in U.S. Pat. Nos. 4,108,802, 4,118,231, 4,126,467 and 4,137,217, etc., and cross-linkage type polymer latexes described in U.S. Pat. No. 4,070,189 and German Patent Application (OLS) No. 2,830,767 (U.S. Ser. No. 816,127), etc.

The photosensitive materials are provided with an electrically conductive layer. However, it is necessary to monitor certain factors in order to reduce light scattering by the electrically conductive layer: specifically, the fact that light scattering occurs not only in the inner part of the electrically conductive layer but also on interfaces between the electrically conductive layer and other substances.

When providing the electrically conductive layer in the inner part of the photosensitive material as a subbing layer for a sensitive emulsion layer (or as an intermediate layer for a plurality of sensitive emulsion layers), the light scattering caused on the interface between the two layers does not have a very large influence. The effect of the interface is small because the binder for the electrically conductive layer has nearly the same refractive index as the binder for the sensitive emulsion layer. However, when providing the electrically conductive layer on the upper part of the sensitive emulsion layer or on the back of the photosensitive material (on a place contacting with outer medium which is generally air), light scattering occurs at the interface between the electrically conductive layer and the medium. In order to restrain this light scattering, a coating layer is placed over the electrically conductive layer. Formation of the coating layer is one of the preferred embodiments of the present invention. The coating layer functions as a protective layer for the electrically conductive layer.

The preferred amount of electrically conductive particles is 0.05 to 20 g, particularly 0.1 to 10 g, per square meter of the photosensitive material.

In order to reduce the resistance of the electrically conductive layer by more effectively using electrically conductive particles, it is preferred that a volume content of the electrically conductive particles in the electrically conductive layer is higher. However, it is preferred to incorporate at least 5% or so of the binder in order to give the layer sufficient strength. Accordingly, the volume content of the electrically conductive particles is preferably in a range of 5 to 95%. However, the above-described ranges vary depending on factors such as the type of photographic film base used, photographic compositions, forms or coating methods.

According to the present invention, the electrically conductive layer may be provided at any position in the layer structure of silver halide photosensitive materials, e.g., as a subbing layer, an intermediate layer, an uppermost layer, etc. The electrically conductive layer may also be provided as a photosensitive emulsion layer by incorporating the electrically conductive particles of this invention into a silver halide emulsion layer, since the particles do not influence the photographic properties of the silver halide emulsion.

Bases of the photosensitive materials used in the present invention include cellulose nitrate films, cellulose acetate films, cellulose acetate butyrate films, cellulose acetate propionate films, polystyrene films, polyethylene terephthalate films, polycarbonate films and laminates of them. Specific examples include baryta, or papers coated or laminated with α-olefin polymers, particularly, polymers of α-olefin having 2 to 10 carbon atoms, such as polyethylene, polypropylene or ethylene-butene copolymer.

The base may be transparent or opaque depending on the intended use of the sensitive materials. Useful transparent bases include colorless and colored ones obtained by adding dyes or pigments.

When adhesive strength between the base and photographic emulsion layer is insufficient, a subbing layer is provided which is adhesive to both of them. To further improve the adhesive property, the surface of the bases may be subjected to a preliminary treatment such as corona discharging, ultraviolet ray application or flame treatment.

Each photographic construction layer may contain one or more of the following binders: hydrophilic colloids, which include protein such as gelatin, colloidal albumin or casein; cellulose compounds such as carboxymethyl cellulose or hydroxyethyl cellulose; saccharide derivatives such as agar, sodium alginate or starch derivatives; and synthetic hydrophilic colloids, for example, polyvinyl alcohol, poly-N-vinylpyrrolidone, acrylic acid copolymer, polyacrylamide and derivatives and partially hydrolyzed products thereof.

Gelatin is the binder most often used. The term "gelatin" is meant to include lime-treated gelatin, acid-treated gelatin and enzyme-treated gelatin. Part or all of the gelatin can be replaced by synthetic high molecular substances, or gelatin derivatives. Gelatin derivatives include modified gelatin prepared by treating amino groups, imino groups, hydroxyl groups or carboxyl groups as functional groups included in the molecule with a reagent having a group capable of reacting with the functional groups, or graft polymers prepared by bonding molecule chains of high molecular substances.

Silver halide emulsions are generally produced by mixing a solution of water-soluble silver salts (for example, silver nitrate) with a solution of water-soluble halides (for example, potassium bromide) in the presence of a solution of a water-soluble high molecular substance such as gelatin. Useful silver halides include silver chloride, silver bromide and mixed silver halides, such as silver chlorobromide, silver iodobromide and silver chloroiodobromide. Particles of these silver halides are produced according to known conventional processes. It is, of course, useful to produce them by the so-called single jet process, a double-jet process, or a controlled double jet process. These photographic emulsions have been described in *The Theory of the Photographic Process,* Edition 3, written by T. H. James and C. E. K. Mees, published by Macmillan Co., and *Chemie Photographique,* written by P. Grafikides, published by Paul Montel Co. The emulsions may be prepared by various processes generally used, such as an ammonia process, a neutral process or an acid process. The sensitivity of the resulted silver halide particles can be increased by heat treatment in the presence of a chemical sensitizing agent (for example, sodium thiosulfate, N,N,N'-trimethyl thiourea, monovalent gold thiocyanato complex, thiosulfate complex salt of monovalent gold, stannous chloride or hexamethylenetetramine) without increasing particle size.

The photographic emulsions may be subjected to spectral sensitization or supersensitization by using polymethine sensitizing dyes such as cyanine, merocyanine or carbocyanine dyes alone or in combination or by using a combination of the polymethine sensitizing dyes with styryl dyes.

Various compounds may be added to the photographic emulsions in order to prevent deterioration of sensitivity or fogging during production, preservation or processing of the sensitive materials. Examples of such compounds include heterocyclic compounds including 4-hydroxy-6-methyl-1,3,3a,7-tetrazaindene-3-methylbenzothiazole and 1-phenyl-5-mercaptotetrazole; mercury contained compounds; mercapto compounds; and metal salts. Examples of useful compounds are described in *The Theory of the Photographic Process,* Ed. 3 (1966) by T. H. James and C. E. K. Mees, published by Macmillan Co.

Color photographic sensitive materials may incorporate couplers in the silver halide emulsion layers. Useful couplers include 4-equivalent type diketomethylene yellow couplers and 2-equivalent type diketomethylene yellow couplers, such as compounds described in U.S. Pat. Nos. 3,277,157, 3,408,194 and 3,551,155 and Japanese Patent Application (OPI) Nos. 26133/72 and 66836/73; 4-equivalent type and 2-equivalent type pyrazolone magenta couplers and imidazolone magenta couplers as described in U.S. Pat. Nos. 2,600,788, 3,214,437 and 3,476,560 and Japanese Patent Application (OPI) No. 26133/72; and α-naphthol cyan couplers and phenol cyan couplers as described in U.S. Pat. Nos. 2,474,293, 3,311,476 and 3,481,741. It is also possible to use couplers capable of releasing a development inhibitor, as described in U.S. Pat. Nos. 3,227,554, 3,253,924, 3,379,529, 3,617,291 and 3,770,436.

The silver halide emulsion layers and other hydrophilic colloid layers can be hardened by various kinds of organic or inorganic hardening agents. Typical examples include: aldehyde compounds such as mucochloric acid, formaldehyde, trimethylol melamine, glyoxal, 2,3-dihydroxy-1,4-dioxane, 2,3-dihydroxy-5-methyl-1,4-dioxane, succinaldehyde or glutaraldehyde; active vinyl compounds such as divinyl sulfone, methylene bismaleimide, 1,3,5-triacryloyl-hexahydro-s-triazine, 1,3,5-trivinylsulfonylhexahydro-s-triazine, bis(vinylsulfonylmethyl)ether, 1,3-bis(vinylsulfonylmethyl)propanol-2 or bis(α-vinylsulfonylacetamido)ethane; active halogen compounds such as 2,4-dichloro-6-hydroxy-s-triazine sodium salt or 2,4-dichloro-6-methoxy-s-triazine; and ethyleneimine compounds such as 2,4,6-triethyleneimino-s-triazine.

Surface active agents may be added alone or in combination to the photographic construction layers. These agents are used primarily as a coating assistant; but are also useful for emulsifying or dispersing, improvement of photographic properties such as sensitization, or control of an electrification order.

Examples of surface active agents include: natural surface active agents such as saponin; nonionic surface active agents such as alkylene oxide type, glycerine type or glycidol type agents; cationic surface active agents such as higher alkylamines, quaternary ammonium salts, pyridinium and other heterocyclic compounds, phosphoniums or sulfoniums; anionic surface active agents containing an acid group such as a carboxylic acid group, sulfonic acid group, phosphoric acid group, sulfuric acid ester group or phosphoric acid ester group; and ampholytic surface active agents such as amino acids, aminosulfonic acids or sulfuric or phosphonic acid esters of aminoalcohols. Fluorine type surface active agents may be used to obtain similar effects.

Examples of these surface active agents are described in U.S. Pat. Nos. 2,271,623, 2,240,472, 2,288,226; 2,739,891, 3,068,101, 3,158,484, 3,201,253, 3,210,191, 3,294,540, 3,415,649, 3,441,413, 3,442,654, 3,475,174, 3,545,974, 3,666,478 and 3,507,660, British Pat. No. 1,198,450, and *Kaimenkasseizai no Gosei to sono Oyo,* written by Ryohei Oda (Makishoten Co., 1964), *Surface Active Agents,* written by A. W. Perry (Interscience Publication Incorporated, 1958) and *Encyclopedia of Active Agents,* vol. 2, written by J. P. Sisley (Chemical Publish Company, 1964).

The electrically conductive particles of the present invention are most effective in preventing the generation of static marks when used in combination with fluorine type surface active agents. Examples of such fluorine type surface active agents are described in British Pat. Nos. 1,330,356 and 1,524,631, U.S. Pat. Nos. 3,666,478 and 3,589,906, Japanese Patent Publication No. 26687/77 and Japanese Patent Application (OPI) Nos. 46733/74 and 32322/76. Specific examples of these compounds include: N-perfluorooctylsulfonyl-N-propylglycine potassium salt, 2-(N-perfluorooctylsulfonyl-N-ethylamine)ethylphosphate, N-[4-(perfluorononenyloxy)benzyl]-N,N-dimethylammonioacetate, N-[3-(N',N',N'-trimethylammonio)propyl]perfluorooctylsulfonamido iodide, N-(polyoxyethylenyl)-N-propyl-perfluorooctylsulfonamide ($C_8F_{17}SO_2N(C_3H_7)(CH_2CH_2O)_nH$) and fluorine contained succinic acid compounds.

The photographic construction layers may contain a lubricant composition, for example, modified silicone described in U.S. Pat. Nos. 3,079,837, 3,080,317, 3,545,970 and 3,294,537 and Japanese Patent Application (OPI) No. 129520/77.

The photographic construction layers may contain polymer latexes described in U.S. Pat. Nos. 3,411,911 and 3,411,912 and Japanese Patent Publication No. 5331/70, or silica, strontium sulfate, barium sulfate or polymethyl methacrylate, as a matting agent.

By utilizing the electrically conductive particles of the present invention in the manner indicated herein, it is possible to eliminate or reduce static charges created during the production of the photosensitive material and/or during use. For example, occurrence of static marks caused by touch of the emulsion face of the photosensitive material with the back face thereof, touch of the emulsion face with another emulsion face, or touch of the emulsion face with materials which usually come in contact with the photosensitive materials, such as rubber, metal, plastics or fluorescence sensitization paper, can be remarkably reduced by practicing.

The effect of the present invention is illustrated in detail with reference to examples, but the present invention is not limited thereto.

EXAMPLE 1

65 parts by weight of stannic chloride hydrate and 1.5 parts by weight of antimony trichloride were dissolved in 1,000 parts by weight of ethanol to obtain a homogeneous solution. To this solution, a 1N aqueous solution of sodium hydroxide was added dropwise till the pH of the solution became 3 to obtain a co-precipitate of colloidal stannic oxide and antimony oxide. The resulting co-precipitate was allowed to stand at 50° C. for 24 hours to obtain a reddish brown colloidal precipitate.

The reddish brown colloidal precipitate was separated by centrifugal separation. In order to remove excess ions, water was added to the precipitate and the precipitate was washed by centrifugal separation. This operation was repeated three times to remove excess ions.

100 parts of the colloidal precipitate from which excess ions were removed were mixed with 50 parts by weight of barium sulfate having an average particle size of 0.3μ and 1,000 parts by weight of water. The mixture was sprayed in a sintering furnace heated to 900° C. to obtain a powdery mixture having an average particle size of 0.1μ consisting of stannic oxide and barium sulfate.

When the relative resistivity of the powder was measured by putting 1 g of the mixture in an insulative cylinder (the inside diameter: 1.6 cm) and sandwiching the mixture with two stainless steel electrodes at a pressure of 1,000 kg/cm$^2$, the relative resistivity of the powder was 11Ω-cm.

EXAMPLE 2

A mixture consisting of:

| | parts by weight |
|---|---|
| $SnO_2$ powder prepared in Example 1 | 10 |
| 10% aqueous solution of gelatin | 50 |
| Water | 100 |

was dispersed for 1 hour by a paint shaker (produced by Toyo Seiki Seisakusho Co.) to prepare an electrically conductive coating solution.

This electrically conductive coating solution was applied to a 100μ polyethylene terephthalate (PET) film by a coating rod so that a dried coating amount was 2 g/m$^2$ to obtain an electrically conductive base.

The resulting electrically conductive base was allowed to stand for 2 hours under a condition of 25° C. and 25% RH. The surface resistivity of the electrically conductive layer was measured by an insulation resistance tester (Type VE-30, produced by Kawaguchi Denki Co.). The surface resistivity was $3\times10^6$Ω.

When the light scattering of the above-described electrically conductive base was measured by a light scattering tester (produced by Narumi Co.), it was 50%.

EXAMPLE 3

A mixture consisting of:

| | parts by weight |
|---|---|
| $SnO_2$ powder obtained in Example 1 | 10 |
| 10% aqueous solution of gelatin | 50 |
| Water | 100 |
| 1% aqueous solution of ammonia | 1 |

was dispersed for 1 hour by a paint shaker to prepare an electrically conductive coating solution.

The resulting electrically conductive coating solution was applied to a 100μ PET film in the same manner as in Example 2 so that the dry weight was 2 g/m$^2$.

The resulting electrically conductive base was allowed to stand for 2 hours under a condition of 25° C. and 25% RH. When the surface resistivity was measured in the same manner as in Example 2, it was $3\times10^6\Omega$. When the light scattering was measured, it was 30%.

EXAMPLE 4

A mixture consisting of:

| | parts by weight |
|---|---|
| $SnO_2$ powder obtained in Example 1 | 10 |
| Water | 150 |
| 30% aqueous solution of ammonia | 1 |

was dispersed for 1 hour by a paint shaker to obtain a homogeneously dispersed solution. This dispersed solution was subjected to centrifugal separation at 2,000 rpm for 30 minutes to remove large particles. The residual supernatant solution was processed by centrifugal separation at 3,000 rpm for 1 hour to obtain an $SnO_2$ paste comprising fine particles.

10 parts by weight of the above-described $SnO_2$ paste were mixed with 25 parts by weight of a 10% aqueous solution of gelatin and 100 parts by weight of water. The mixture was dispersed for 1 hour by a paint shaker to prepare an electrically conductive solution.

This electrically conductive coating solution was applied to a 100μ PET film in the same manner as in Example 2 so that the dry weight was 2 g/m$^2$ to obtain an electrically conductive base.

This base was allowed to stand for 2 hours under a condition of 25° C. and 25% RH. When the surface resistivity was measured, it was $2\times10^6\Omega$. When the light scattering was measured, it was 15%.

EXAMPLE 5

To an electrically conductive layer of the electrically conductive base produced in Example 4, a 2% aqueous solution of gelatin was applied by a coating rod so that the dry weight was 0.4 g/m$^2$.

The resulting electrically conductive base was allowed to stand for 2 hours under a condition of 25° C. and 25% RH. When the surface resistivity was measured, it was $2\times10^6\Omega$. When the light scattering was measured, it was 9%.

EXAMPLE 6

A mixture consisting of:

| | parts by weight |
|---|---|
| $SnO_2$ powder obtained in Example 1 | 10 |
| Potassium polyvinyl benzene-sulfonate | 5 |
| Water | 100 |

-continued

| | parts by weight |
|---|---|
| 1% aqueous solution of ammonia | 1 |

was dispersed for 1 hour by a paint shaker to prepare an electrically conductive coating solution.

The resulting electrically conductive coating solution was applied to a 100μ PET film in the same manner as in Example 2 so that the dry weight was 2 g/m$^2$ to obtain an electrically conductive base.

The resulting electrically conductive base was allowed to stand for 2 hours under a condition of 25° C. and 25% RH. When the surface resistivity of the electrically conductive layer was measured by the same manner as in Example 2, it was $3\times10^6\Omega$. When the light scattering was measured, it was 30%.

EXAMPLE 7

10 parts by weight of an $SnO_2$ powder obtained in Example 1 were mixed with 10 parts by weight of a 42.8% aqueous emulsion of an acrylic resin (AP 106, produced by Toa Gosei Chemical Industry Co.), 90 parts by weight of water and 1 part by weight of a 1% aqueous solution of ammonia, and the mixture was dispersed for 1 hour by a paint shaker to prepare an electrically conductive coating solution.

The resulting electrically conductive coating solution was applied to a 100μ PET film in the same manner as in Example 2 so that the dry weight was 2 g/m$^2$ to obtain an electrically conductive base.

The resulting electrically conductive base was allowed to stand for 2 hours under a condition of 25° C. and 25% RH. When the surface resistivity of the electrically conductive layer was measured, it was $1.8\times10^6\Omega$. When the light scattering was measured, it was 25%.

EXAMPLE 8

80 g of many silver halide emulsions having the following composition (high speed negative emulsion) were prepared, respectively. To the emulsions, an aqueous dispersion of the $SnO_2$ powder obtained in Example 1 was added in various contents, and the emulsions were dissolved at 40° C. for 15 minutes. Then, they were shaken at 40° C. for 10 minutes. Thereafter, they were allowed to stand at 40° C. for 5 minutes to produce $SnO_2$ powder containing silver halide emulsions.

Composition of Silver Halide Emulsion
- Binder: Gelatin 9.15 g/emulsion 80 g
- Composition of silver halide: AgI 8.5 mol% and AgBr 91.5 mol%; Br excess 20 mol%
- Silver content: $4.42\times10^{-2}$ mol%

Composition of Additive
- Potassium polyvinyl benzenesulfonate (2% solution): 2 cc/emulsion 80 g
- Sodium dodecylbenzenesulfonate (1% solution): 2 cc/emulsion 80 g Dispersing Condition of $SnO_2$ Powder/Aqueous Dispersion
- Dispersions prepared by dispersing 5 mg, 20 mg, 80 mg and 200 mg of the $SnO_2$ powder in 34 cc of water, respectively.

4 kinds of silver halide emulsion containing the $SnO_2$ powder in the above-described amount were applied to a 100 μm polyethylene terephthalate film, respectively, so that the dry silver content was 3.2 to 3.3 g/m$^2$ to prepare $SnO_2$ powder containing silver halide photosensitive materials. For comparative purposes, a silver halide photosensitive material which did not contain the $SnO_2$ powder was prepared by the same manner.

Samples produced in the above-described manner, samples subjected to a dry-thermo test (50° C., 20% RH, 7 days) and samples subjected to a wet-thermo test (50° C., 80% RH, 7 days) were examined. The amount of fog and the sensitivity of each silver halide emulsion layer was measured. The developing solution used was Developer D 76 (produced by Eastman Kodak Co.). The development was carried out under 20° C. for 8 minutes.

Table 3 shows that there was no increase in fog due to the presence of the $SnO_2$ powder.

TABLE 3

| | Amount of Fog | | | | |
|---|---|---|---|---|---|
| | $SnO_2$ Powder Content (mg) | | | | |
| | None | 5 | 20 | 80 | 200 |
| No Thermo Test | 0.1 | 0.1 | 0.1 | 0.1 | 0.1 |
| Dry-Thermo Test | 0.1 | 0.12 | 0.1 | 0.11 | 0.1 |
| Wet-Thermo Test | 0.24 | 0.25 | 0.24 | 0.24 | 0.24 |

When sensitivities at a density of fog+0.2 of the samples were compared, samples subjected to a dry-thermo test and a wet-thermo test had sensitivities of 112 and 63, respectively, regardless of the presence of $SnO_2$ powder and the amount thereof based on the sensitivity of the comparative sample which was not subjected to the thermo test and did not contain the $SnO_2$ powder as 100, except that the sample containing 200 mg of $SnO_2$ which was subjected to a wet-thermo test had a sensitivity of 100.

From the above-described results, it is clear that the use of electrically conductive metal oxides (such as used in the present invention) did not influence the photographic properties of the silver halide emulsions.

EXAMPLE 9

A mixture consisting of:

| | parts by weight |
|---|---|
| Zinc oxide | 100 |
| 10% aqueous solution of $Al(NO_3)_3.9H_2O$ | 5 |
| Water | 100 |

was subjected to ultrasonic application for 10 minutes to obtain a homogeneously dispersed solution. After this dispersed solution was dried at 110° C. for 1 hour, it was sintered at 600° C. for 5 minutes under $1\times10^{-4}$ Torr to obtain zinc oxide having a relative resistivity of $2\times10^{2}\Omega-cm$. The particle size was $2\mu$. The particles were crushed by a ball mill to obtain particles having $0.7\mu$ of the average particle size.

EXAMPLE 10

A mixture consisting of:

| | parts by weight |
|---|---|
| ZnO powder obtained in Example 9 | 10 |
| Water | 150 |

was dispersed for 1 hour by a paint shaker to obtain a homogeneously dispersed solution. This dispersed solution was subjected to centrifugal separation at 1,000 rpm for 30 minutes to remove large particles. The residual supernatant solution was subjected to centrifugal separation at 2,000 rpm for 1 hour to obtain a ZnO paste.

10 parts by weight of the above-described ZnO paste were mixed with 25 parts by weight of a 10% aqueous solution of gelatin and 100 parts by weight of water. The mixture was dispersed for 1 hour by a paint shaker to prepare an electrically conductive coating solution.

This electrically conductive solution was applied to a $100\mu$ PET film in the same manner as in Example 2 so that the dry weight was 2 g/m$^2$ to obtain an electrically conductive base.

When the surface resistivity of the base was measured after being allowed to stand for 2 hours under a condition of 25° C. and 25% RH, it was $3\times10^{9}\Omega$.

EXAMPLE 11

To an electrically conductive base obtained in Example 10, an emulsion layer and a protective layer were applied in this order by a conventional method and dried to form a silver halide photographic emulsion layer. The composition of each layer was as follows.

Emulsion Layer: about $5\mu$
- Binder: Gelatin 2.5 g/m$^2$
- Silver content coated: 5 g/m$^2$
- Composition of silver halide: AgI 1.5 mol% and AgBr 98.5 mol%
- Hardening agent: 2,4-Dichloro-6-hydroxy-1,3,5-triazine sodium salt 0.4 g/100 g gelatin
- Anti-fogging agent: 1-Phenyl-5-mercaptotetrazole 0.5 g/Ag 100 g Protective Layer: about $1\mu$
- Binder: Gelatin 1.7 g/m$^2$ and potassium polystyrenesulfonate (average molecular weight: about 70,000) 0.3 g/m$^2$
- Coating agent: N-Oleoyl-N-methyltaurine sodium salt 7 mg/m$^2$ Results of measuring photographic properties of the photosensitive material showed that there were no variations of fog and sensitivity by the electrically conductive coating solution.

EXAMPLE 12

A mixture of 65 parts by weight of stannic chloride pentahydrate and 4 parts by weight of antimony trichloride was dissolved in 1,000 parts by weight of ethanol to prepare a uniform solution. To the uniform solution, 1N aqueous sodium hydroxide solution was added dropwise until the pH of the solution reached 3 to thereby obtain co-precipitated colloidal stannic oxide and antimony oxide.

The red-brown colloidal precipitate thus-obtained was separated with a centrifugal separator. In order to remove excessive ions, water was added to the precipitate and the resulting mixture was subjected to centrifugal separation to wash the precipitate.

The thus-obtained excessive ion-free colloidal precipitate (100 parts by weight) was mixed with 1,000 parts by weight of water. The resulting mixture was sprayed in a burning furnace maintained at 700° C. to obtain bluish particles of stannic oxide.

The same procedures as in Example 10 were repeated using the stannic oxide particles to prepare an electrically conductive base. The surface resistance of the electrically conductive base was found to be $2\times10^{6}\Omega$. When a silver halide photosensitive material was prepared using the electrically conductive base in the same manner as in Example 11, no deterioration in fog and sensitivity was observed.

EXAMPLE 13

2.7 parts by weight of niobium pentachloride was dissolved in 50 parts by weight of ethanol, and 65 parts by weight of titanium oxide fine particles (particle size: 0.02–0.05$\mu$; TTO-55, produced by Ishihara Sangyo Kaisha Ltd.) was added thereto, under stirring, to obtain a dispersion. The dispersion was heated to 60° C. and allowed to stand for 3 hours to thereby evaporate ethanol. The resulting powder was charged in a porcelain crucible and burned at 800° C. for 5 minutes under vacuum ($1\times10^{-4}$ mmHg) to obtain bluish particles having a specific resistance of $5\times10^{2}\Omega-$cm.

Using the particles, the same procedures as in Example 10 were repeated, and the surface resistance of the resulting electrically conductive base was found to be $3\times10^{8}\Omega$. When a silver halide photosensitive material was prepared using the electrically conductive base in the same manner as in Example 11, no deterioration in fog and sensitivity was observed.

While the invention has been described in detail and with reference to specific embodiments thereof, it will be apparent to one skilled in the art that various changes and modifications can be made therein without departing from the spirit and scope thereof.

What is claimed is:

1. A silver halide photosensitive element having an improved antistatic property comprising a silver halide layer, a base support and an electrically conductive layer on said base support, said electrically conductive layer comprising fine particles of a crystalline metal oxide selected from the group consisting of ZnO, $TiO_2$, $SnO_2$, $Al_2O_3$, $ZrO_3$, $In_2O_3$, $SiO_2$, MgO, BaO and $MoO_3$ or a composite oxide thereof dispersed in an organic film-forming binder, said electrically conductive layer being formed by dispersing said fine particles of a crystalline metal oxide in said binder and coating the same, the light-scattering efficiency of said photosensitive material being 50% or less, wherein said electrically conductive layer has a surface resistivity of $10^{11}\Omega$ or less at 25° C. under 25% relative humidity.

2. A silver halide photosensitive element as claimed in claim 1, wherein said crystalline metal oxide is selected from the group consisting of ZnO, $TiO_2$ and $SnO_2$.

3. A silver halide photsensitive element as claimed in any of claims 1 or 2, wherein said crystalline metal oxide includes a hetero atom selected from the group consisting of Al and In for ZnO; Nb and Ta for $TiO_2$; and Sb, Nb and halogens for $SnO_2$.

4. A silver halide photosensitive element as claimed in claim 3, wherein said hetero atom is contained in said metal oxide in a range of 0.01 to 30 mol%.

5. A silver halide photosensitive element as claimed in claim 4, wherein said hetero atom is contained in said metal oxide in a range of 0.1 to 10 mol%.

6. A silver halide photosensitive element as claimed in claim 1, wherein said surface resistivity is $10^{9}\Omega$ or less.

7. A silver halide photosensitive element as claimed in any of claims 1 or 2, wherein said fine particles of crystalline metal oxide are contained in an amount of 0.05 to 20 g per square meter of photosensitive element.

8. A silver halide photosensitive element as claimed in claim 7, wherein said particles are contained in an amount of 0.1 to 10 g per square meter of photosensitive element.

9. A silver halide photosensitive element as claimed in claim 1, wherein said electrically conductive particles have a particle size of about 0.5$\mu$ or less.

10. A silver halide photosensitive element as claimed in claim 1, wherein said electrically conductive particles have a particle size of about 0.2$\mu$ or less.

11. A silver halide photosensitive element as claimed in claim 9, wherein said binder is an electrically conductive high molecular weight organic substance.

12. A silver halide photosensitive element as claimed in claim 10, wherein said binder is an electrically conductive high molecular weight organic substance.

13. A silver halide photosensitive element as claimed in claim 9, wherein said binder has a refractive index of about 1.4 to 1.6.

14. A silver halide photosensitive element as claimed in claim 10, wherein said binder has a refractive index of about 1.4 to 1.6.

* * * * *